US010838357B2

(12) United States Patent
Nakajima

(10) Patent No.: US 10,838,357 B2
(45) Date of Patent: Nov. 17, 2020

(54) IMAGE FORMING APPARATUS

(71) Applicant: CANON KABUSHIKI KAISHA, Tokyo (JP)

(72) Inventor: Keita Nakajima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/706,454

(22) Filed: Dec. 6, 2019

(65) Prior Publication Data

US 2020/0192277 A1 Jun. 18, 2020

(30) Foreign Application Priority Data

Dec. 18, 2018 (JP) ..... 2018-236801

(51) Int. Cl.
*G03G 21/20* (2006.01)

(52) U.S. Cl.
CPC ..... *G03G 21/203* (2013.01)

(58) Field of Classification Search
CPC ..... G03G 21/203
See application file for complete search history.

(56) References Cited

U.S. PATENT DOCUMENTS 8,977,173 B2 * 3/2015 Matsubara ..... G03G 15/2017 399/322
2006/0110172 A1 * 5/2006 Iijima ..... G03G 15/2003 399/44
2015/0316890 A1 * 11/2015 Okuda ..... B65H 23/26 399/341

FOREIGN PATENT DOCUMENTS

JP 2007-086509 A 4/2007
JP 2007-284173 A 11/2007
JP 2008-114991 A 5/2008
JP 2010-128300 A 6/2010
JP 2014-178481 A 9/2014

* cited by examiner

*Primary Examiner* — Gregory H Curran
(74) *Attorney, Agent, or Firm* — Canon U.S.A., Inc. I.P. Division

(57) ABSTRACT

In an image forming apparatus, a removal unit includes a sheet member that has elasticity and contacts a rotator, and an absorption member that is thicker than the sheet member and arranged opposite to the rotator via the sheet member to absorb a water droplet, and the absorption member absorbs the water droplet removed by the sheet member from the rotator.

19 Claims, 9 Drawing Sheets

IMAGE FORMING APPARATUS

BACKGROUND OF THE INVENTION

Field of the Invention

The present disclosure relates to an image forming apparatus that forms an image on a sheet.

Description of the Related Art

Conventionally, an image forming apparatus transfers a toner image to a transfer material, and fixes the toner image on a sheet with heat and pressure. Lastly, the image forming apparatus discharges the sheet with the fixed toner image to a discharge tray using a discharge device.

In a fixing process, the sheet is heated by a heating member, so that moisture absorbed in the sheet is evaporated and becomes vapor or steam. Particularly, sheets placed in high humidity environment may have a high water absorption rate. In such a case, if a large number of such sheets having a high water absorption rate are continuously conveyed, generated moisture adheres more easily as water droplets to a member near the heating member.

Moreover, the generated water droplets may adhere to a conveyance unit on a conveyance path. In such a case, the water droplets adhere to a sheet from the conveyance unit. Particularly, if water droplets adhere to a roller of the conveyance unit, the water droplets adhere to a sheet. Such adhesion of the water droplets to the sheet may cause a sheet jam or wrinkles of the sheet. Consequently, a toner image fixed on the sheet may be affected.

Japanese Patent Application Laid-Open No. 2010-128300 discusses a configuration in which a water absorption member that absorbs water droplets contacts a discharge roller of a conveyance unit.

However, in the configuration discussed in Japanese Patent Application Laid-Open No. 2010-128300, the water absorption member directly contacts a rotator such as a discharge roller. Thus, if a soft water absorption member is scraped, water absorbency may not be maintained. In addition, if the roller in contact with the absorption member moves, a deformation amount of the absorption member varies depending on a thickness of the sheet. This may cause a variation in water absorbency.

SUMMARY OF THE INVENTION

The present disclosure is directed to reduction of degradation in water absorbability of an absorption member.

According to an aspect of the present disclosure, an image forming apparatus includes an image forming unit configured to form a toner image, a fixing unit configured to fix the toner image transferred to a sheet from the image forming unit on the sheet, a conveyance unit arranged on a downstream side of the fixing unit in a sheet conveying direction and including a rotator that contacts the sheet and rotates to convey the sheet, and a removal unit configured to remove a water droplet adhering to the conveyance unit, wherein the removal unit includes a sheet member that has elasticity and contacts the rotator, and an absorption member that is thicker than the sheet member and arranged opposite to the rotator via the sheet member to absorb the water droplet, the absorption member absorbing the water droplet removed by the sheet member from the rotator.

Further features of the present disclosure will become apparent from the following description of exemplary embodiments with reference to the attached drawings.

DESCRIPTION OF THE EMBODIMENTS

A first exemplary embodiment is described with reference to the drawings. However, dimensions, materials, shapes, and relative arrangements of components described in the exemplary embodiment can be changed appropriately based on configurations or various conditions of an apparatus of the exemplary embodiment. That is, description of each exemplary embodiment below is not intended to limit the scope of the present disclosure.

Figure 1:
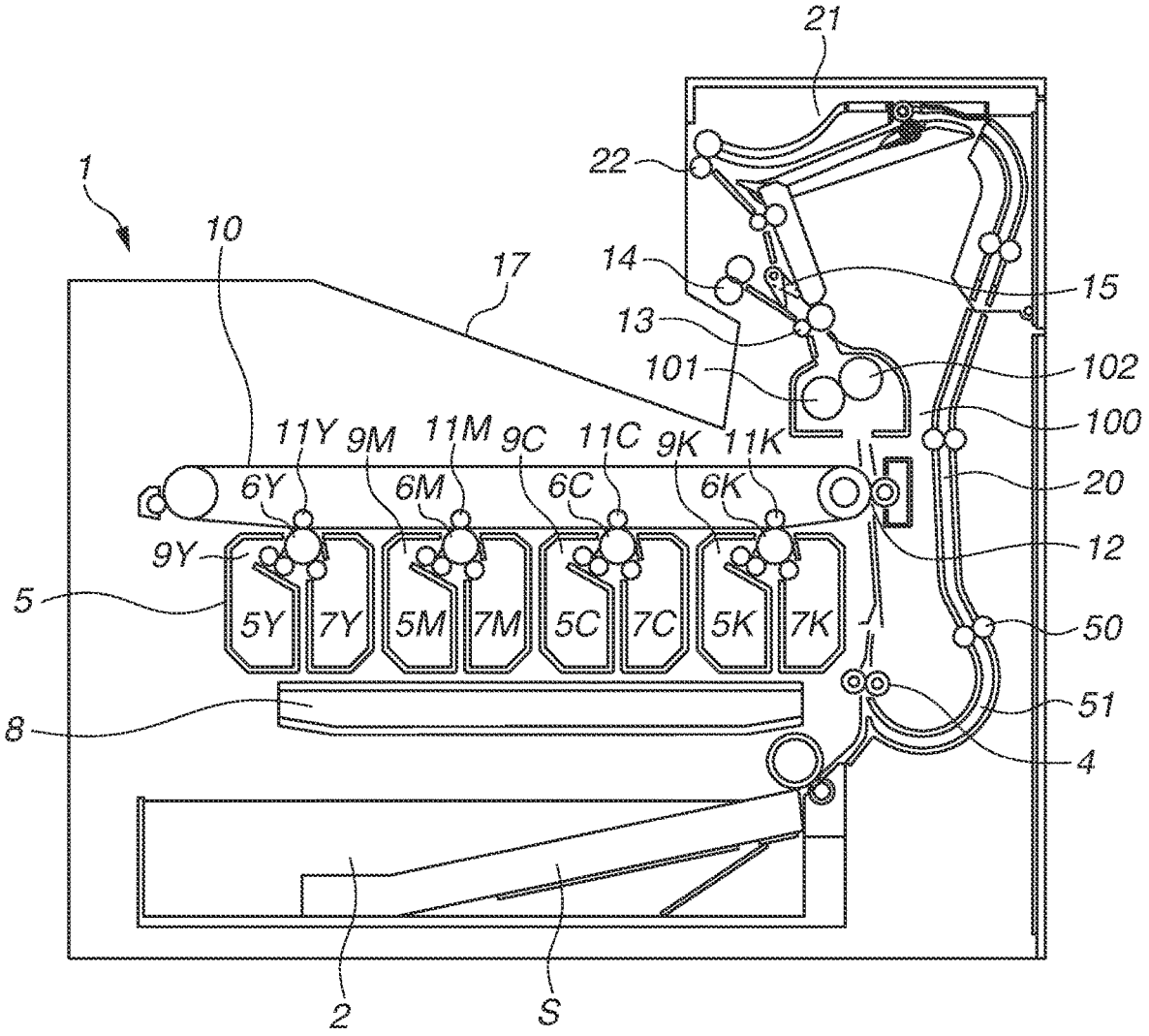
FIG. 1 is a sectional view illustrating a configuration of an image forming apparatus according to a first exemplary embodiment.

FIG. 1 is a sectional view illustrating a configuration of an image forming apparatus using a color electrophotographic method. However, the present exemplary embodiment is not limited to the image forming apparatus employing an electrophotographic process. The present exemplary embodiment can be applied to an image forming apparatus employing another method. For example, the present exemplary embodiment can be applied to a printer employing an inkjet image forming process.

A color laser beam printer (hereinafter referred to as a printer 1) as the image forming apparatus according to the present exemplary embodiment is described. In the present exemplary embodiment, a color laser beam printer including a plurality of photosensitive drums 6 is described as the image forming apparatus. However, the present exemplary embodiment can be applied to a monochrome printer including a single photosensitive drum 6.

The printer 1 includes a cassette 2 that can be pulled out from a main body of the printer 1. In the cassette 2, sheets S in a bundle are stored. The sheets S are fed toward an image forming unit 5 by a feeding roller based on an image forming signal. The fed sheets S are separated one by one by a separation member, and the separated sheet S reaches a registration roller 4.

The printer 1 includes the image forming unit 5 in which image forming stations 5Y, 5M, 5C, and 5K for respective colors of yellow, magenta, cyan, and black are aligned side by side. The image forming unit 5 includes photosensitive drums 6Y, 6M, 6C, and 6K (hereinafter referred to as photosensitive drums 6) as image bearing members, and charging members 7Y, 7M, 7C, and 7K that uniformly charge surfaces of the photosensitive drums 6. Moreover, the image forming unit 5 includes developing members 9Y, 9M, 9C, and 9K that causes toner to adhere to electrostatic latent images to develop the electrostatic latent images into toner images. In the present exemplary embodiment, the photosensitive drum 6Y, the charging member 7Y, and the developing member 9Y are configured as a process cartridge of a single unit detachable from the main body of the printer 1. Similarly, the photosensitive drums, the charging members, and the developing members of the other colors are configured as process cartridges.

A scanner unit 8 is arranged below the image forming stations 5Y, 5M, 5C, and 5K. The scanner unit 8 emits laser beams based on image information to form electrostatic latent images on the photosensitive drums 6.

The toner images on the photosensitive drums 6 are primarily transferred to an intermediate transfer belt 10 by primary transfer members 11Y, 11M, 11C, and 11K. The toner image primarily transferred to the intermediate transfer belt 10 is secondarily transferred to the sheet S in a secondary transfer portion 12 formed of the intermediate transfer belt 10 and a secondary transfer member.

The secondarily transferred toner image on the sheet S is fixed on the sheet S by a fixing device 100. The fixing device 100 includes a fixing member 101 including a heat source, and a pressing member 102 that is pressed against the fixing member 101.

In single-sided printing, a switching flapper 15 is in a position indicated by a dotted line, and the sheet S is conveyed to a conveyance roller pair 13 and a discharge roller pair 14. Lastly, after passing through the discharge roller pair 14, the sheet S is discharged to a sheet stacking unit 17.

In duplex printing, the switching flapper 15 is in a position indicated by a solid line. Accordingly, when the sheet S is conveyed from the conveyance roller pair 13 to a reverse roller pair 22, the sheet S is switchback-conveyed. The sheet S to be switchback-conveyed is conveyed from the reverse roller pair 22 to a duplex conveyance path 20 including a refeeding roller pair 50. Subsequently, the sheet S is conveyed from a refeeding path 51 to the registration roller 4, and again fed to the secondary transfer portion 12. Since an image forming process to be performed on a second surface of the sheet S is similar to that performed on the first surface of the sheet S, the description thereof is omitted.

The printer 1 includes the conveyance roller pair 13, the discharge roller pair 14, the reverse roller pair 22, and a duplex conveyance roller pair 24 as conveyance units on a downstream side of the fixing device 100 in a sheet conveying direction (see FIG. 2). A water droplet D may adhere to these conveyance units.

Figure 2A:
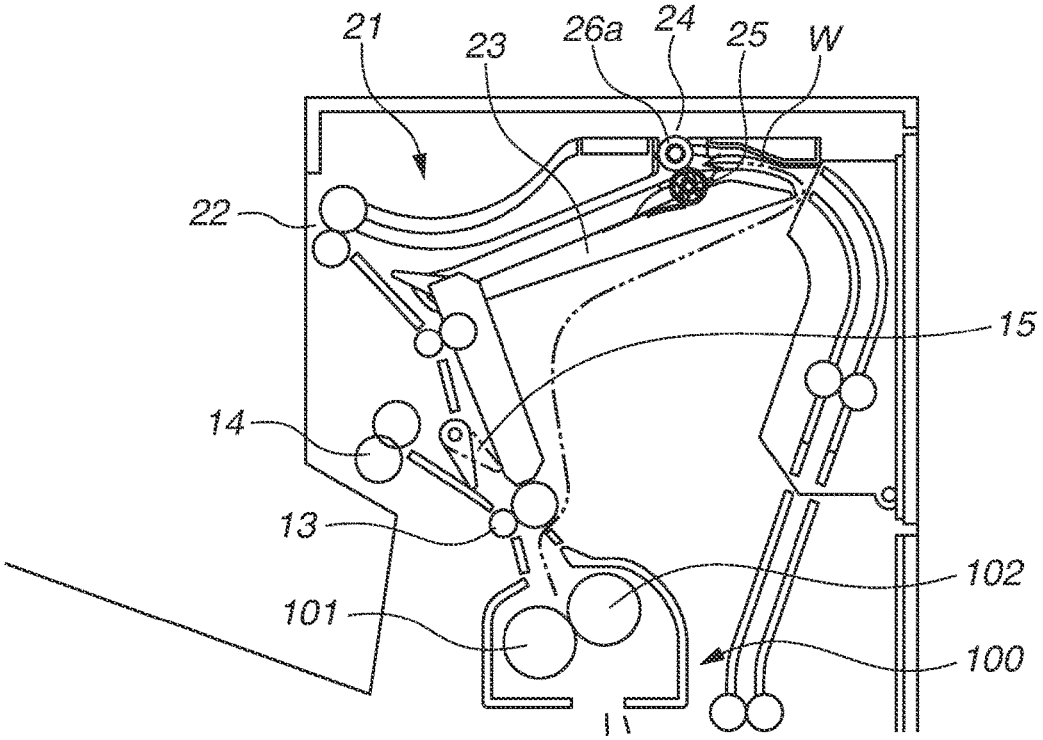
FIG. 2A is a sectional view illustrating a periphery of a reverse conveyance unit.
Figure 2B:
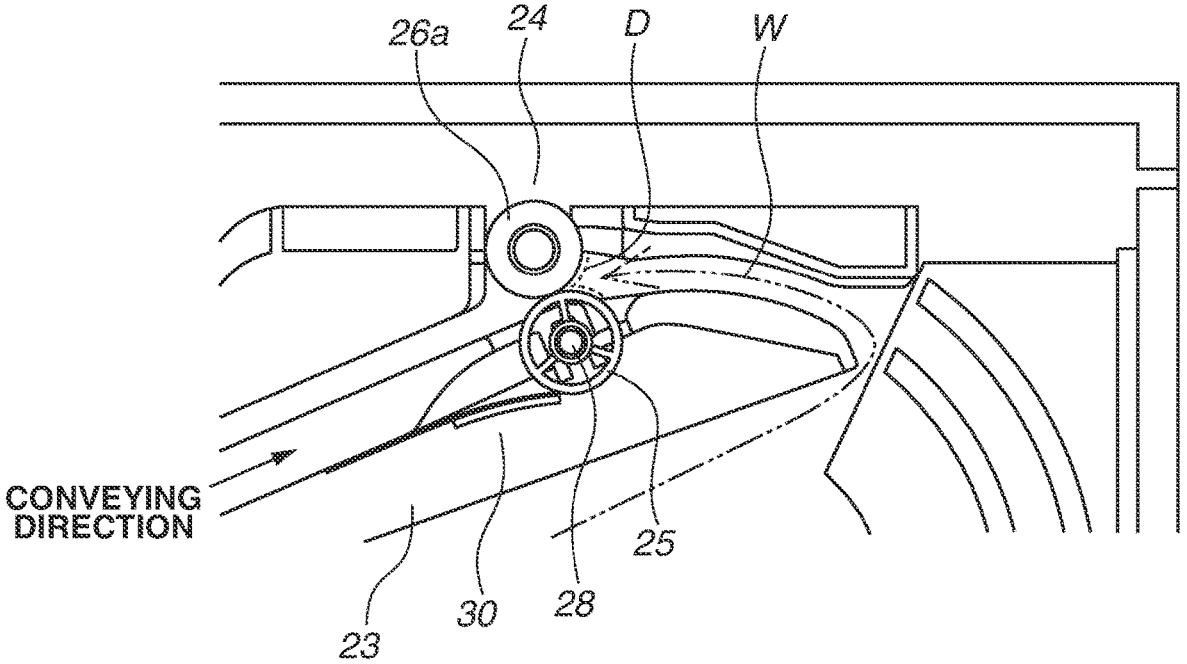
FIG. 2B is an enlarged view illustrating the periphery of the reverse conveyance unit.

In the present exemplary embodiment, a removal device is arranged to remove the water droplet D adhering to the duplex conveyance roller pair 24. In particular, as illustrated in FIGS. 2A and 2B, the duplex conveyance roller pair 24 as the conveyance unit includes a duplex conveyance roller 26*a* as a first conveyance member and a duplex conveyance idler roller 25 as a second conveyance member, and the removal device is arranged to contact the duplex conveyance idler roller 25. The duplex conveyance roller 26*a* is a drive roller to which a driving force is transmitted from a drive source, whereas the duplex conveyance idler roller 25 is a driven roller that is driven by the drive roller.

FIG. 2A is a sectional view illustrating the periphery of a reverse conveyance unit 21. A two-dot chain line W indicates an air current of vapor or steam generated in the fixing device 100. FIG. 2B is an enlarged view illustrating the periphery of the reverse conveyance unit 21.

During the single-sided printing, the duplex conveyance roller pair 24 is not rotated, the warm moist upward air current W flows to a downstream side of the duplex conveyance roller pair 24 in a conveying direction, and the water droplet D adhere to surfaces of the duplex conveyance roller 26*a* and the duplex conveyance idler roller 25. That is, vapor reaches a conveyance nip portion formed of the duplex conveyance roller 26*a* and the duplex conveyance idler roller 25.

The duplex conveyance roller 26*a* is made of rubber such as ethylene propylene diene monomer (EPDM) rubber and silicon rubber, and the duplex conveyance idler roller 25 is made of a material such as polyacetal (POM) resin.

As illustrated in FIG. 2B, the upward air current W curves around a leading end of a duplex conveyance lower guide 23 serving as a conveyance guide, and adheres as water droplet D to the duplex conveyance roller 26*a* serving as a drive rotator and the duplex conveyance idler roller 25.

Figure 3A:
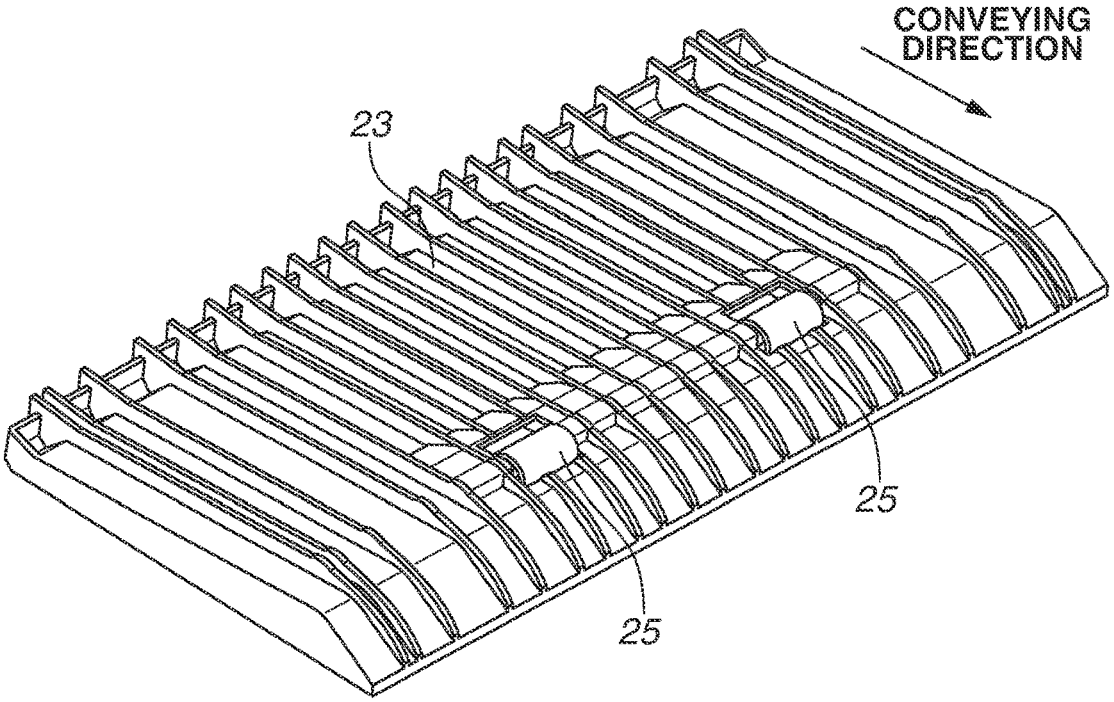
FIGS. 3A and 3B are perspective views each illustrating a conveyance guide according to the first exemplary embodiment.
Figure 3B:
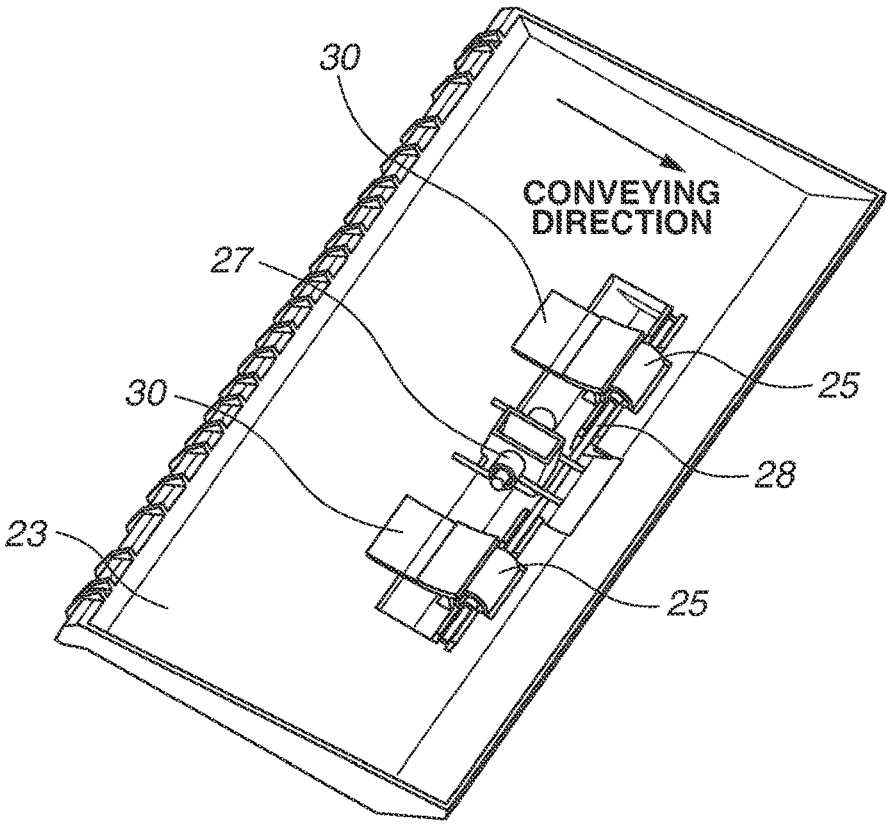

Each of FIGS. 3A and 3B is a perspective view of the duplex conveyance lower guide 23 that guides sheet conveyance. FIG. 3A illustrates a conveyance surface side of the duplex conveyance lower guide 23, and FIG. 3B illustrates a non-conveyance surface side of the duplex conveyance lower guide 23. The duplex conveyance lower guide 23 includes two duplex conveyance idler rollers 25 as rotators, a duplex idler roller shaft 28 as a shaft member, and a pressing spring 27 as an urging member, and supports the duplex conveyance idler rollers 25, the duplex idler roller shaft 28, and the pressing spring 27. Moreover, the duplex conveyance lower guide 23 includes a plurality of removal units 30 (two removal units 30 in the present exemplary embodiment) as removal devices in an axial direction. At a center of each of the two duplex conveyance idler rollers 25, a hole is formed. The duplex idler roller shaft 28 passes through the holes of the duplex conveyance idler rollers 25. The pressing spring 27 is pressed against the duplex idler roller shaft 28, so that the duplex conveyance idler roller 25 is pressed against the duplex conveyance roller 26*a*.

Figure 4A:
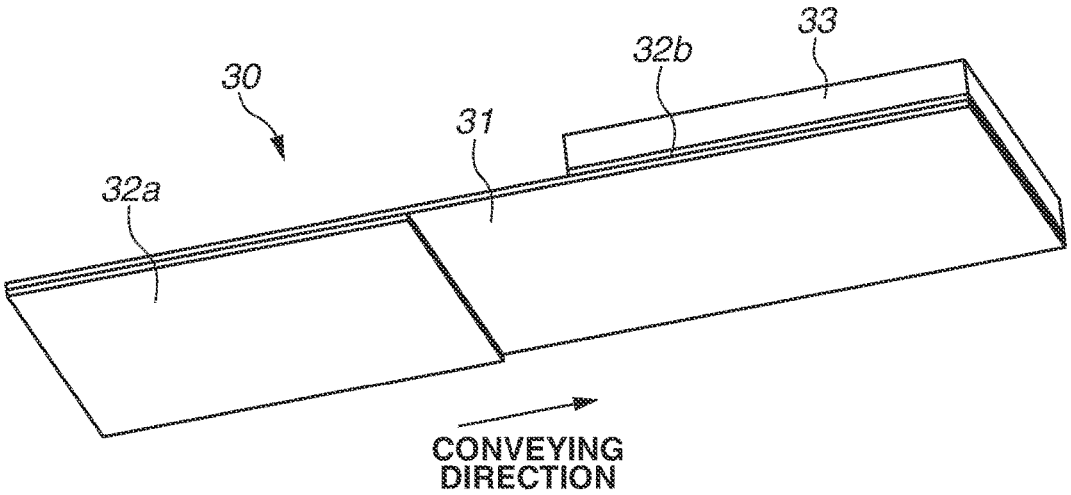
FIG. 4A is a perspective view illustrating a removal unit.
Figure 4B:
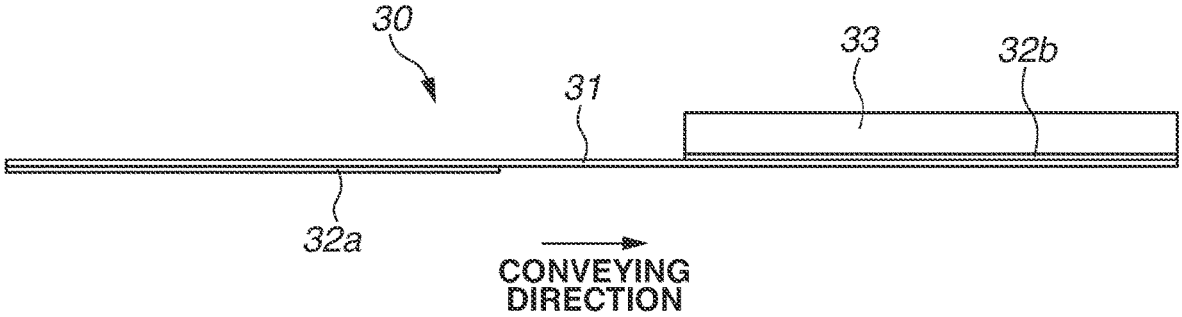
FIG. 4B is a sectional view illustrating the removal unit.

FIG. 4A is a perspective view of the removal unit 30, and FIG. 4B is a sectional view of the removal unit 30.

The removal unit 30 includes a sheet member 31 as a reference member, and an affixing member 32*a* as a first adhesive member. The affixing member 32*a* arranged on a second surface (a back surface) of the sheet member 31 affixes the sheet member 31 to the duplex conveyance lower guide 23. Moreover, the removal unit 30 includes an affixing member 32*b* as a second adhesive member. The affixing member 32*b* is arranged on a first surface (a front surface) of the sheet member 31. An absorption member 33 is affixed to the sheet member 31 with the affixing member 32*b*. That is, the sheet member 31 has one end side to which the absorption member 33 is affixed, and the other end side, which is affixed to the duplex conveyance lower guide 23.

As for the sheet member 31, an elastic body such as a polyethylene terephthalate (PET) elastic body is used. Thus, a pressing force by rigidity of the sheet member 31 is generated, so that durability of water droplet scraping performance can be enhanced. The sheet member 31 has a thickness within a range of 0.1 mm to 0.5 mm. In the present exemplary embodiment, the sheet member 31 has a thickness of 0.125 mm.

The absorption member 33 is made of a material, for example, polyurethane sponge or nonwoven fabric, having not only good water absorbency, but also flexibility so that the absorption member 33 can follow a bending shape of the sheet member 31. Each of the affixing members 32*a* and 32*b* can be a two-sided adhesive tape or an adhesive having certain flexibility not to interfere with bending of the sheet member 31 and the absorption member 33. The absorption member 33 is thicker than the sheet member 31, and a thickness of the absorption member 33 is within a range of 0.5 mm to 3.0 mm. In the present exemplary embodiment, the absorption member 33 has a thickness of 1.0 mm.

Figure 5A:
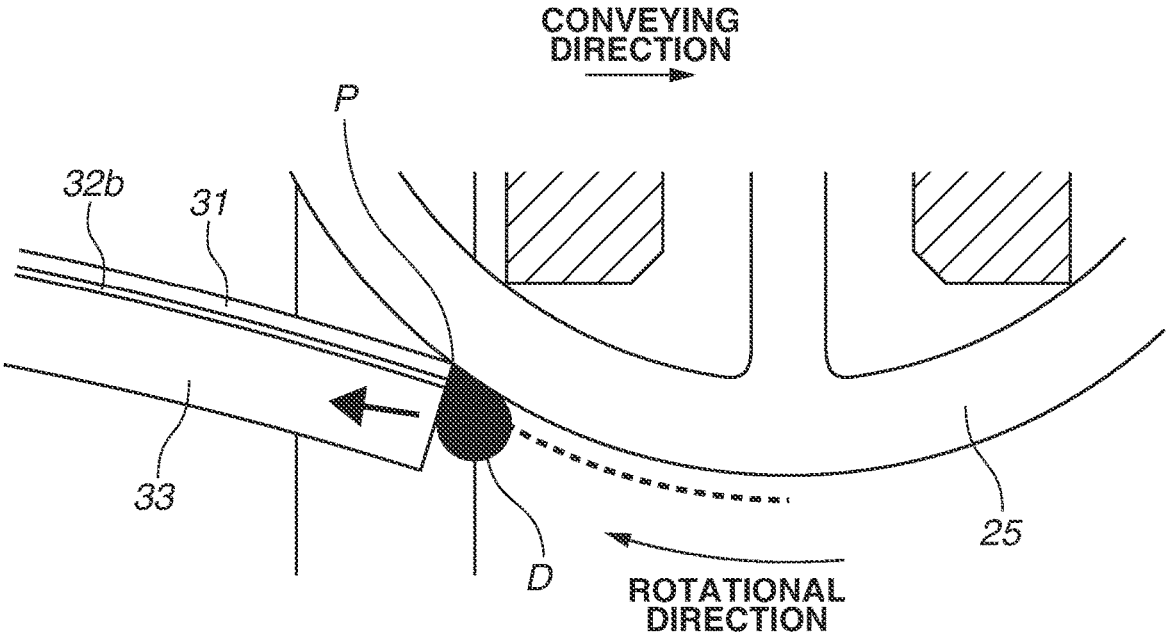
FIG. 5A is an enlarged view illustrating a contact portion formed of the removal unit and a rotator.
Figure 5B:
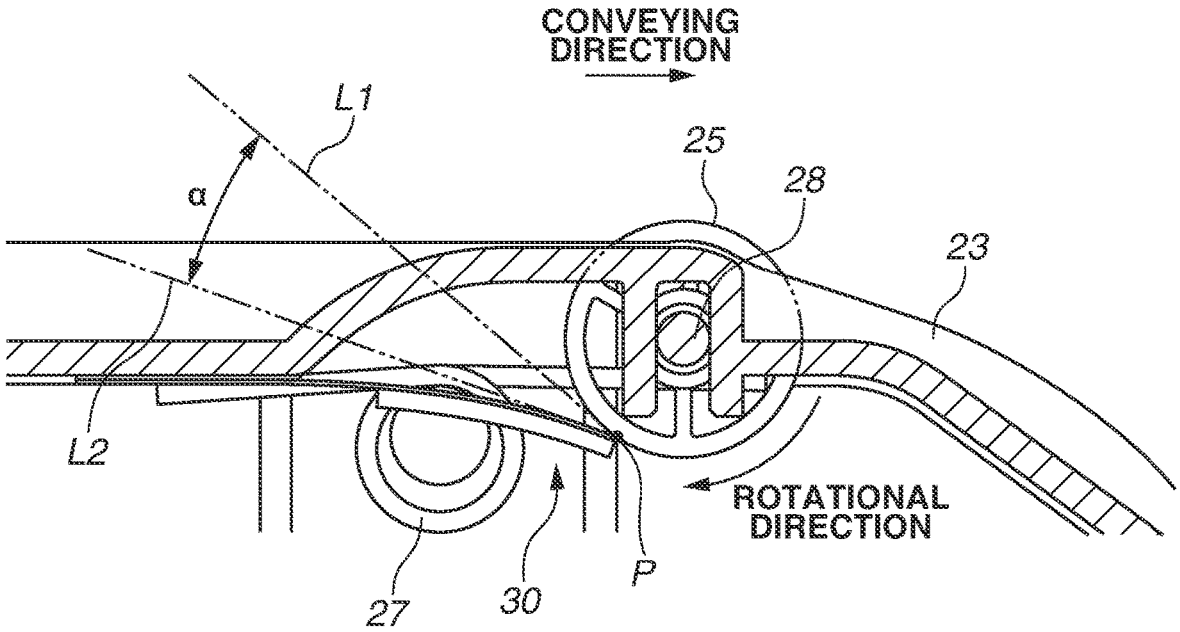
FIG. 5B is a sectional view illustrating tangent lines L1 and L2.

FIG. 5A is an enlarged view illustrating a contact portion P formed of the removal unit 30 and the duplex conveyance idler roller 25. FIG. 5B is a sectional view illustrating tangent lines L1 and L2. An end portion (an edge) of one end side (on the side of the contact portion P illustrated in FIG. 5A) of the sheet member 31 to which the absorption member 33 is affixed contacts the duplex conveyance idler roller 25 so as to oppose a rotational direction of the duplex conveyance idler roller 25.

When the duplex printing begins, the duplex conveyance roller 26*a* is rotated by a driving force transmitted from a drive source (not illustrated) before a sheet S is conveyed to the duplex conveyance roller pair 24. The rotation of the duplex conveyance roller pair 24 moves the water droplet D adhering to the duplex conveyance idler roller 25 to the contact portion P, and the water droplet D is scraped by the sheet member 31. The scraped water droplets D are collected into a large water droplet. Then, the water droplet D is absorbed into the absorption member 33 by a capillary action. The water droplets D adhering to the duplex conveyance roller 26*a* move to an upstream side of the duplex conveyance roller pair 24 in the conveying direction, and are collected at the conveyance nip portion. However, the collected water droplets D gradually slip through to a downstream side of the conveyance nip portion. Then, the water droplet D is transferred to the duplex conveyance idler roller 25, so that the transferred water droplet D is absorbed into the removal unit 30. As a result, the water droplets adhering to surfaces of the duplex conveyance roller 26*a* and the duplex conveyance idler roller 25 are removed by the removal unit 30, thereby reducing an amount of water droplets to adhere to the sheet S conveyed to the duplex conveyance roller pair 24.

Here, a line, which passes the contact portion P formed of the sheet member 31 and the duplex conveyance idler roller 25 and is tangent to an ouster circumferential surface of the duplex conveyance idler roller 25 extending in the rotational direction of the duplex conveyance idler roller 25 from the contact portion P, is set to a virtual line L1. In a case where a line, which passes the contact portion P and is tangent to the sheet member 31, is set to a virtual line L2, an angle between the virtual line L1 and virtual line L2 is set to an angle $\alpha$. The angle $\alpha$ is set to be more than 0° and less than 90° at all times even if the duplex conveyance idler roller 25 moves toward a direction of the duplex conveyance roller 26*a*.

In a case where $0° < \alpha < 90°$, an end portion of the sheet member 31 is in contact with the duplex conveyance idler roller 25. Moreover, since the sheet member 31 is always bent, and a pressing force by rigidity of the sheet member 31 is generated to the duplex conveyance idler roller 25, water droplet scraping performance of the sheet member 31 is enhanced. Thus, such a setting is made.

Figure 6:
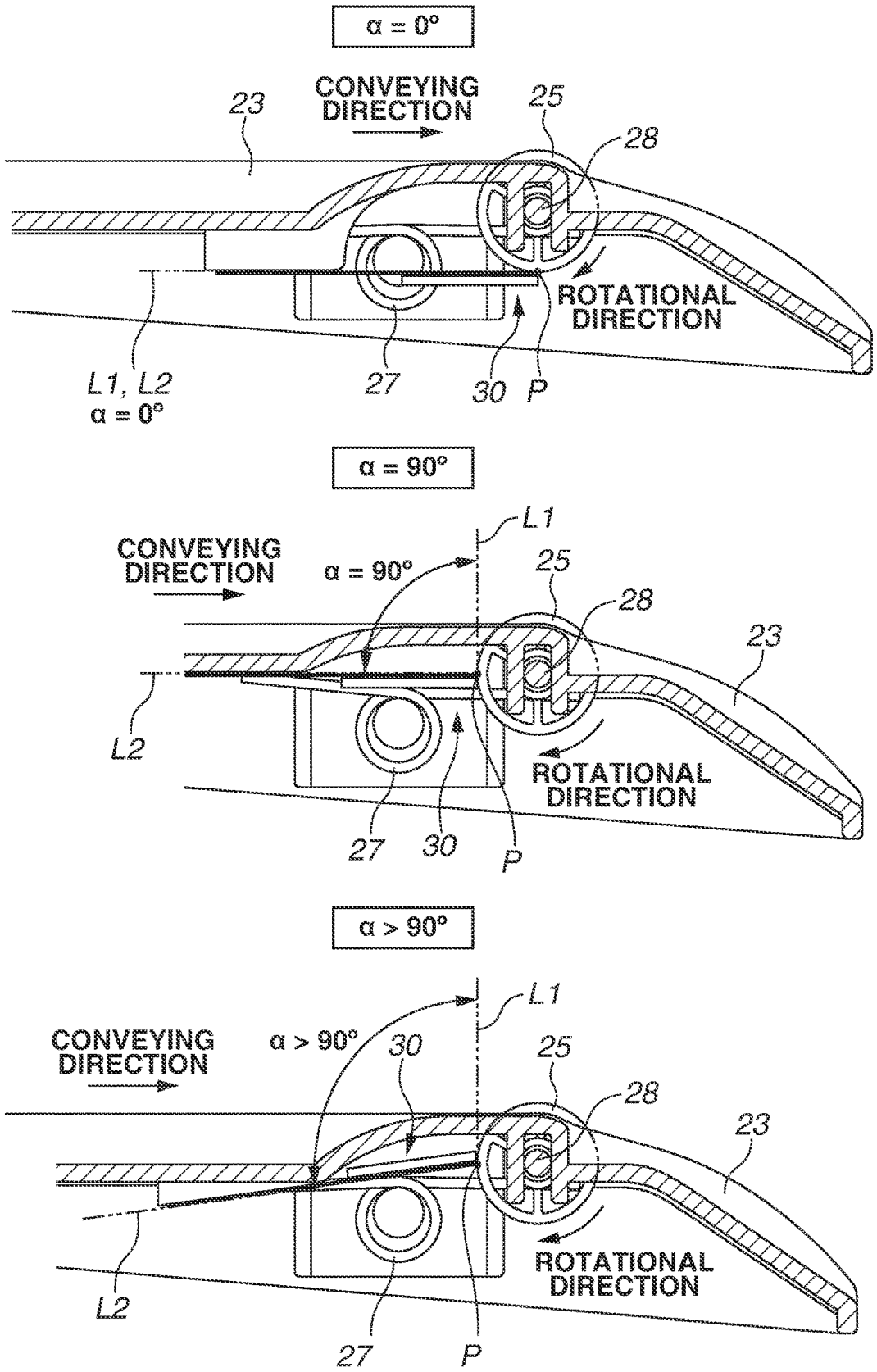
FIG. 6 is a sectional view illustrating a comparative example.

FIG. 6 is a sectional view illustrating a comparative example. In a case where $\alpha=0°$, the sheet member 31 is not bent, and there is no pressing force of the sheet member 31 to the duplex conveyance idler roller 25. Thus, water droplet scraping performance is degraded. In a case where $\alpha=90°$, the sheet member 31 is not bent, and there is no pressing force of the sheet member 31 to the duplex conveyance idler roller 25. Thus, water droplet scraping performance is degraded. In a case where $\alpha>90°$, the contact portion P of the sheet member 31 has an angle that follows the rotational direction of the duplex conveyance idler roller 25. Consequently, water droplet scraping performance is degraded.

Accordingly, in a case other than $00<\alpha<90°$, water droplet scraping performance by the removal unit 30 is degraded.

Figure 7A:
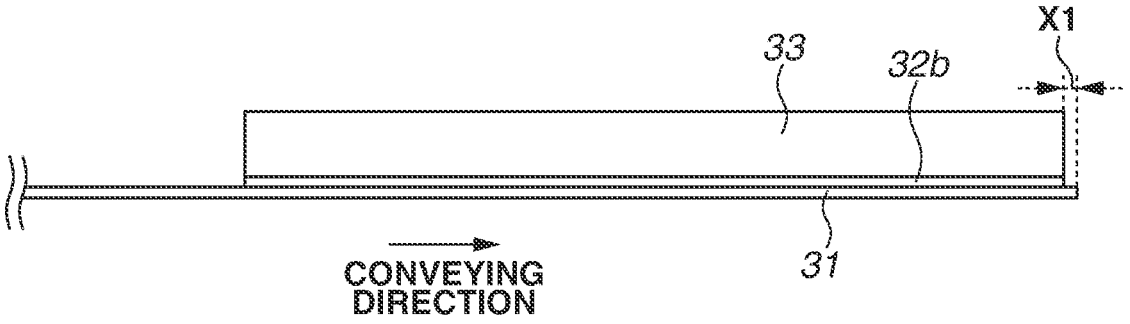
FIGS. 7A and 7B are sectional views each illustrating a positional relation between an absorption member and a sheet member.
Figure 7B:
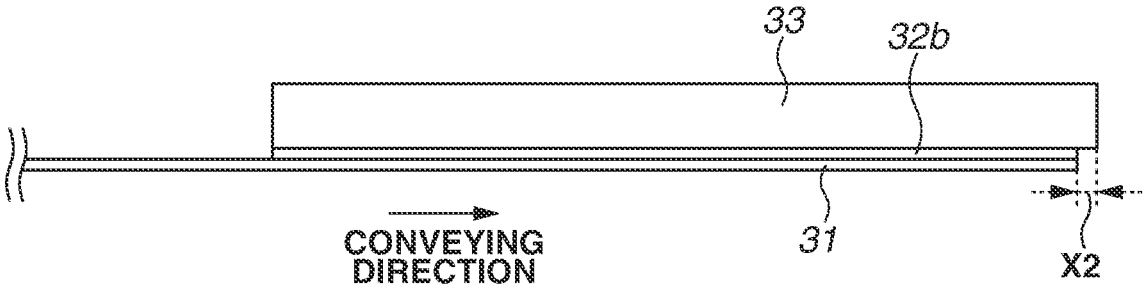

A positional relation between the absorption member 33 and the sheet member 31 is described with reference to FIGS. 7A and 7B. Since the water droplet D is to be absorbed into the absorption member 33 by the capillary action, a distance from an end portion of the absorption member 33 to an end portion of the sheet member 31 needs to be arranged such that the scraped water droplet D contacts the absorption member 33. Accordingly, a leading end portion of the absorption member 33 is desirably positioned within 2 mm (X1 in FIG. 7A) from a leading end portion of the sheet member 31 in a direction in which the end portion of the absorption member 33 does not protrude from the end portion of the sheet member 31. Moreover, in a direction in which the leading end portion of the absorption member 33 protrudes from the leading end portion of the sheet member 31, a distance (X2 in FIG. 7B) needs to be arranged such that the absorption member 33 is not wound in the rotational direction by contacting the duplex conveyance idler roller 25. This distance is determined based on rigidity of the absorption member 33 or an outer diameter or a surface friction coefficient of the duplex conveyance idler roller 25.

In the present exemplary embodiment, the sheet member 31, which scrapes the water droplet D adhering to the duplex conveyance idler roller 25, and the absorption member 33, which absorbs the scraped water droplet D, are separate components to function separately. Such a configuration can stabilize water absorbency without degradation in water absorbability of the absorption member due to durability or variation in deformation amounts of the absorption member.

The first exemplary embodiment has been described using a configuration in which the removal unit 30 is fixed to the duplex conveyance lower guide 23 to remove water droplets from the duplex conveyance idler roller 25. A second exemplary embodiment is described using a configuration for removing water droplets adhering to a drive shaft of the duplex conveyance roller 26*a*. Components similar to those of the first exemplary embodiment are described using the same reference numerals as above.

Figure 8A:
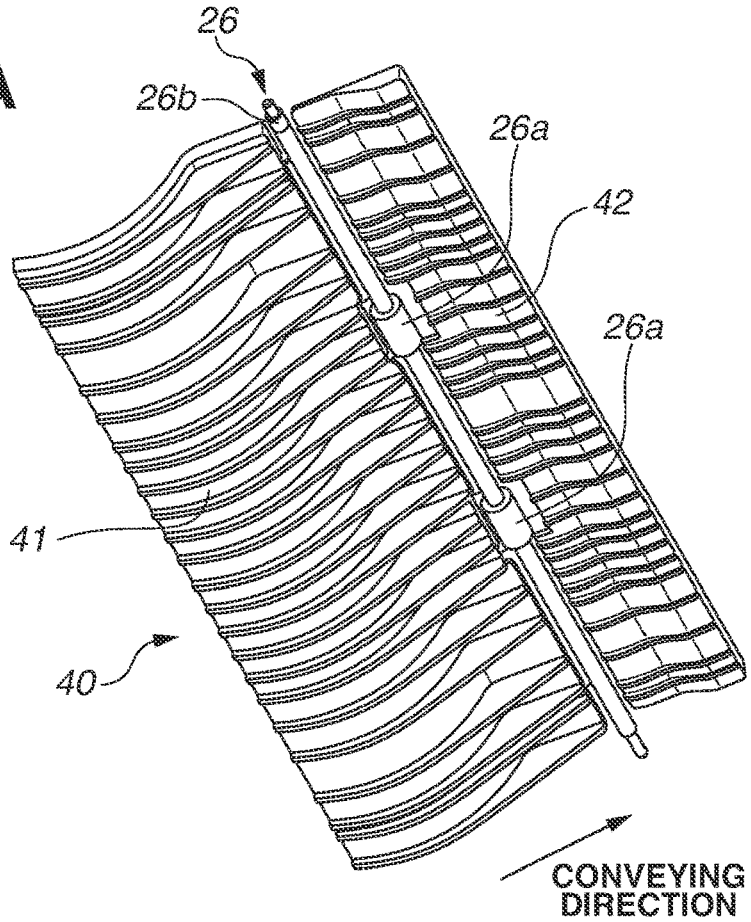
FIGS. 8A and 8B are perspective views each illustrating a conveyance unit according to a second exemplary embodiment.
Figure 8B:
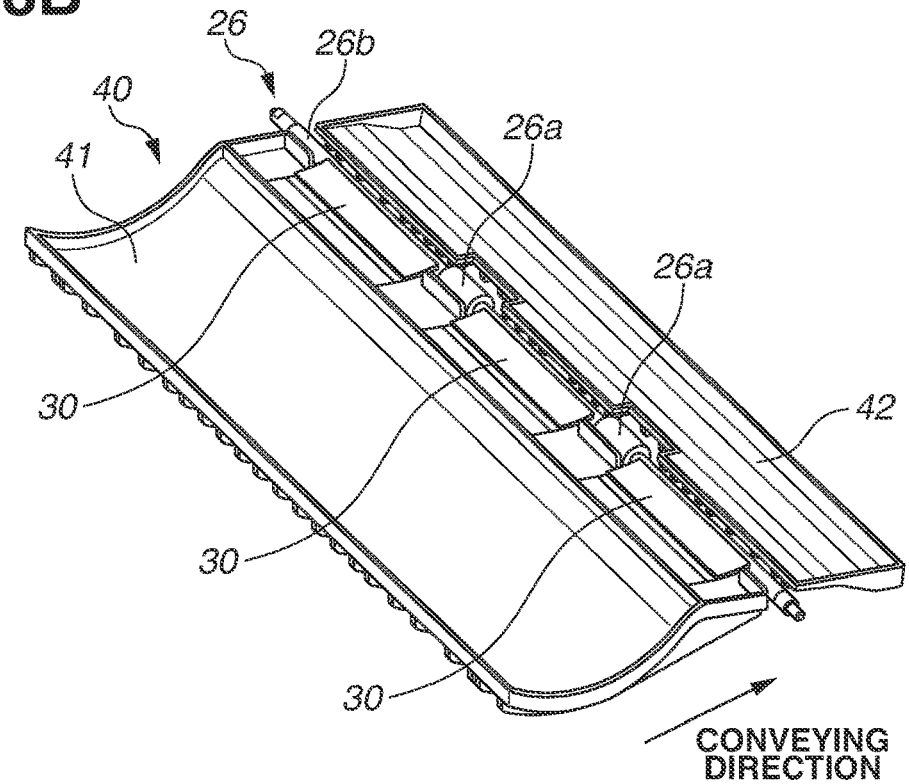

Each of FIGS. 8A and 8B is a perspective view of a duplex conveyance guide unit 40 of a conveyance unit according to the second exemplary embodiment. FIG. 8A illustrates a sheet feeding surface side of the duplex conveyance guide unit 40, and FIG. 8B illustrates a back surface side of the duplex conveyance guide unit 40.

The duplex conveyance guide unit 40 is arranged on an opposite side of the duplex conveyance lower guide 23, and forms a conveyance guide on the periphery of the duplex conveyance roller 26*a*. The duplex conveyance guide unit 40 includes an upstream upper guide 41, the duplex conveyance roller 26*a*, and a downstream lower guide 42 that are arranged in order from an upstream side in a conveying direction.

The duplex conveyance roller 26*a*, serving as a drive rotator, is pressed into a roller shaft 26*b*, which is a metal rotation shaft made of stainless steel. A plurality of duplex conveyance rollers 26*a* and the roller shaft 26*b* form a drive member 26, and the plurality of duplex conveyance rollers 26*a* are rotated by a driving force transmitted by a drive source (not illustrated).

Since the roller shaft 26*b* is made of metal, a heat transfer rate of the roller shaft 26*b* is high. Thus, the roller shaft 26*b* is cooled easily, and moisture condensation is liable to occur. If the moisture condensation occurs on the roller shaft 26*b*, a water droplet D may adhere to the roller shaft 26*b*. In such a case, a sheet S being conveyed directly contacts the water droplet D, or the water droplet D is moved along an outer circumferential surface of the duplex conveyance roller 26*a*, and the thus water droplet D may adhere to the sheet S.

Accordingly, in the present exemplary embodiment, as illustrated in FIG. 8B, the removal unit 30 contacts a roller shaft 26*b*.

Figure 9A:
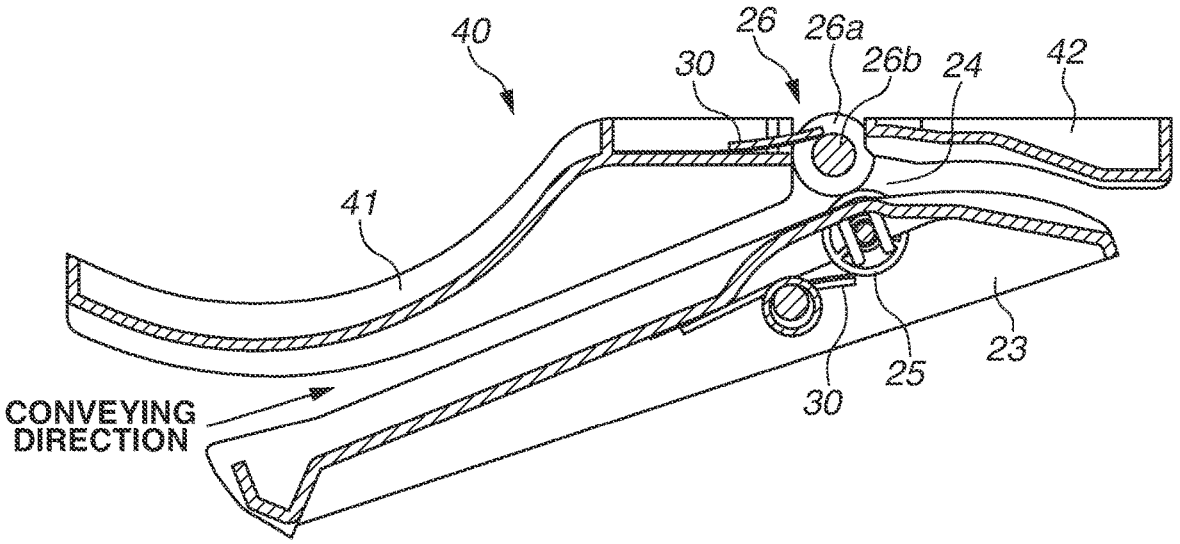
FIGS. 9A and 9B are sectional views each illustrating a relation between a removal unit and a rotation shaft.
Figure 9B:
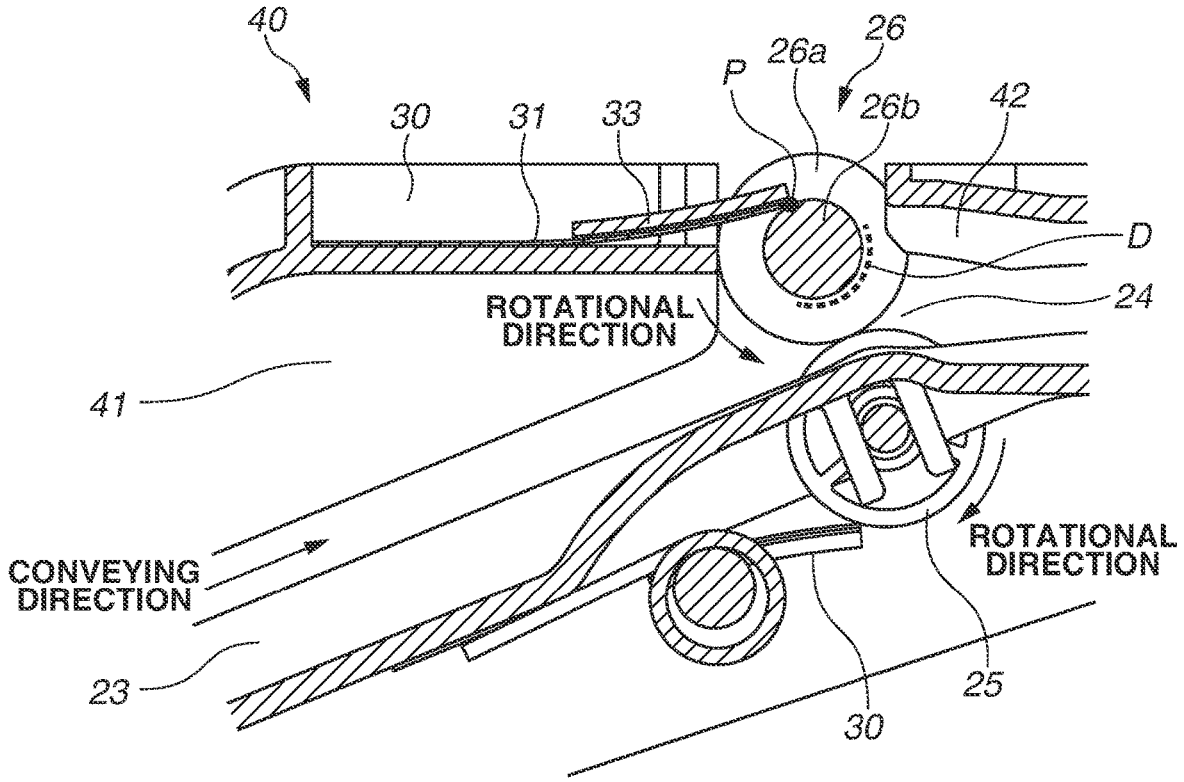

FIG. 9A is a sectional view illustrating a relation between the removal unit 30 and the roller shaft 26*b*, and FIG. 9B is an enlarged view illustrating the relation between the removal unit 30 and the roller shaft 26*b*. As illustrated in FIGS. 9A and 9B, the water droplet D adhering to the roller shaft 26*b* is scraped by the sheet member 31, and the scraped water droplet D is absorbed into the absorption member 33. Accordingly, the configuration in which the removal unit 30 serving as a second removal unit contacts the roller shaft 26*b* has been described. However, the removal unit 30 can only contact the roller shaft 26*b*.

Such a configuration can stabilize water absorbency of the absorption member that absorbs the water droplet D adhering to the roller shaft 26*b* without degradation in water absorbability of the absorption member due to durability or variation in deformation amounts of the absorption member, as similar to the first exemplary embodiment.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-236801, filed Dec. 18, 2018, which is hereby incorporated by reference herein in its entirety.

What is claimed is:

1. An image forming apparatus comprising:

an image forming unit configured to form a toner image;

a fixing unit configured to fix the toner image transferred to a sheet from the image forming unit on the sheet;

a conveyance unit arranged on a downstream side of the fixing unit in a sheet conveying direction and including a rotator that contacts the sheet and rotates to convey the sheet; and a removal unit configured to remove a water droplet adhering to the conveyance unit, wherein the removal unit includes a sheet member that has elasticity and contacts the rotator, and an absorption member that is thicker than the sheet member and arranged opposite to the rotator via the sheet member to absorb the water droplet, the absorption member absorbing the water droplet removed by the sheet member from the rotator.

2. The image forming apparatus according to claim 1, wherein the sheet member has an end portion that contacts the rotator such that the end portion opposes a rotational direction of the rotator, and the sheet member is in a bent state.

3. The image forming apparatus according to claim 1, wherein an angle between a first virtual line and a second virtual line is more than 0° and less than 90°, the first virtual line passing a contact portion of the end portion of the sheet member with respect to the rotator to contact an outer circumferential surface of the rotator and extending in a rotational direction of the rotator from the contact portion, and the second virtual line passing the contact portion and extending to contact the sheet member.

4. The image forming apparatus according to claim 1, wherein a position of a leading end portion of the absorption member relative to a leading end portion of the sheet member is within 2 mm in a direction where the absorption member does not protrude from the sheet member.

5. The image forming apparatus according to claim 1, wherein the conveyance unit includes a conveyance guide configured to guide a sheet to be conveyed, and a drive roller that forms a conveyance nip portion with the rotator, and wherein the conveyance guide is arranged such that vapor generated in the fixing unit reaches the conveyance nip portion from a leading end side of the conveyance guide.

6. The image forming apparatus according to claim 1, wherein the conveyance unit includes a plurality of rotators in an axial direction of the rotator, and wherein a plurality of the removal units is arranged with respect to the plurality of rotators.

7. The image forming apparatus according to claim 5, wherein the sheet member has one end side to which the absorption member is affixed, and another end side that is fixed to the conveyance guide.

8. The image forming apparatus according to claim 7, wherein the absorption member is in a state where the absorption member is affixed to the sheet member with a two-sided adhesive tape.

9. The image forming apparatus according to claim 1, wherein the conveyance unit includes a drive member that forms a conveyance nip portion with the rotator, and wherein the drive member includes a drive rotator and a drive shaft made of metal.

10. The image forming apparatus according to claim 9, further comprising:

a second removal unit configured to remove a water droplet adhering to the drive shaft, wherein the second removal unit includes a sheet member that has elasticity and contacts the drive shaft, and an absorption member that is thicker than the sheet member and arranged opposite to the drive shaft via the sheet member to absorb the water droplet.

11. The image forming apparatus according to claim 1, wherein the conveyance unit includes a drive rotator configured to rotate as the rotator by a transmitted driving force, and a rotation shaft as a shaft portion of the drive rotator, and wherein the sheet member of the removal unit contacts the rotation shaft.

12. An image forming apparatus comprising:

an image forming unit configured to form a toner image;

a fixing unit configured to fix the toner image transferred to a sheet from the image forming unit on the sheet;

a conveyance unit arranged on a downstream side of the fixing unit in a sheet conveying direction and including a rotator that contacts the sheet and rotates to convey the sheet;

a sheet member that has elasticity and contacts the rotator; and a sponge that is thicker than the sheet member and arranged opposite to the rotator via the sheet member, the sponge is more hygroscopic than the sheet member.

13. The image forming apparatus according to claim 12, wherein the sheet member has an end portion that contacts the rotator such that the end portion opposes a rotational direction of the rotator, and the sheet member is in a bent state.

14. The image forming apparatus according to claim 12, wherein an angle between a first virtual line and a second virtual line is more than 0° and less than 90°, the first virtual line passing a con tact portion of the end portion of the sheet member with respect to the rotator to contact an outer circumferential surface of the rotator and extending in a rotational direction of the rotator from the contact portion, and the second virtual line passing the contact portion and extending to contact the sheet member.

15. The image forming apparatus according to claim 12, wherein the conveyance unit includes a conveyance guide configured to guide a sheet to be conveyed, and a drive roller that forms a conveyance nip portion with the rotator, and wherein the conveyance guide is arranged such that vapor generated in the fixing unit reaches the conveyance nip portion from a leading end side of the conveyance guide.

16. An image forming apparatus comprising:

an image forming unit configured to form a toner image;

a fixing unit configured to fix the toner image transferred to a sheet from the image forming unit on the sheet;

a conveyance unit arranged on a downstream side of the fixing unit in a sheet conveying direction and including a rotator that contacts the sheet and rotates to convey the sheet;

a sheet member that has elasticity and contacts the rotator; and a nonwoven fabric that is thicker than the sheet member and arranged opposite to the rotator via the sheet member, the nonwoven fabric is more hygroscopic than the sheet member.

17. The image forming apparatus according to claim 16, wherein the sheet member has an end portion that contacts the rotator such that the end portion opposes a rotational direction of the rotator, and the sheet member is in a bent state.

18. The image forming apparatus according to claim 16, wherein an angle between a first virtual line and a second virtual line is more than 0° and less than 90°, the first virtual line passing a con tact portion of the end portion of the sheet member with respect to the rotator to contact an outer circumferential surface of the rotator and extending in a rotational direction of the rotator from the contact portion, and the second virtual line passing the contact portion and extending to contact the sheet member.

19. The image forming apparatus according to claim 16, wherein the conveyance unit includes a conveyance guide configured to guide a sheet to be conveyed, and a drive roller that forms a conveyance nip portion with the rotator, and wherein the conveyance guide is arranged such that vapor generated in the fixing unit reaches the conveyance nip portion from a leading end side of the conveyance guide.

* * * * *